US006623050B1

(12) United States Patent
Peng

(10) Patent No.: US 6,623,050 B1
(45) Date of Patent: Sep. 23, 2003

(54) SAFETY AND ANTI-THEFT DOOR LOCK ASSEMBLY

(75) Inventor: Fu Chang Peng, Chong Ho (TW)

(73) Assignee: Fu Chang Locks Mfg. Corp., Taipei (TW)

( * ) Notice: Subject to any disclaimer, the term of this patent is extended or adjusted under 35 U.S.C. 154(b) by 0 days.

(21) Appl. No.: 10/165,492

(22) Filed: Jun. 5, 2002

(51) Int. Cl.[7] ..... E05B 65/10
(52) U.S. Cl. ..... 292/92; 292/DIG. 65
(58) Field of Search ..... 292/92, 93, 21, 292/DIG. 65; 70/92

(56) References Cited

U.S. PATENT DOCUMENTS 3,614,145 A * 10/1971 Zawadzki ..... 292/92
3,877,262 A * 4/1975 Williams ..... 70/92
4,709,950 A * 12/1987 Zortman ..... 292/92
4,796,931 A * 1/1989 Heid ..... 292/92
5,219,385 A * 6/1993 Yeh ..... 70/92
5,464,259 A * 11/1995 Cohrs ..... 292/92
5,605,362 A * 2/1997 Surko ..... 292/92
6,009,732 A * 1/2000 Haeck ..... 70/92
6,032,985 A * 3/2000 Cutter ..... 292/92
6,048,000 A * 4/2000 Geringer ..... 292/92

* cited by examiner

*Primary Examiner*—Gary Estremsky

(57) ABSTRACT

A door lock device includes a striker plate for engaging with a latch of a base, and a pawl pivotally secured to the latch and having a tongue biased to lock the latch to the base, to prevent the latch from being rotated relative to the base. A beam is engageable with the pawl for preventing the pawl from moving out of the latch. A bar is biased to engage with the pawl. A catch is pivotally supported on the base has two recesses for selectively receiving the bar in a lower and an upper position. A lever is pivotally secured to the base and has one end for moving the pawl into the latch.

18 Claims, 8 Drawing Sheets

SAFETY AND ANTI-THEFT DOOR LOCK ASSEMBLY

BACKGROUND OF THE INVENTION

1. Field of the Invention

The present invention relates to a door lock assembly, and more particularly to a door lock assembly having a safety and anti-theft structure.

2. Description of the Prior Art

Various kinds of typical door lock assemblies have been developed for anti-theft purposes. However, some of the door locks may also lock the doors for preventing the door from being easily opened from inside of the house buildings. When fires happened, the users may also be locked inside the house building and may not easily escape from the house building.

The other door locks may be easily unlocked by the unauthorized persons by engaging a planer member into the slit formed between the door panel and the door frame or the wall, and by moving or actuating the latch inward of the lock device by the planer member, from outside of the house buildings.

The present invention has arisen to mitigate and/or obviate the afore-described disadvantages of the conventional door lock assemblies.

SUMMARY OF THE INVENTION

The primary objective of the present invention is to provide a door lock assembly including a safety and anti-theft structure for preventing the door from being opened from outside, and for allowing the door to be easily opened from inside of the house building.

In accordance with one aspect of the invention, there is provided a door lock assembly for a door panel, the door lock assembly comprising a striker plate including a cavity formed therein, a base, a latch rotatably supported on the base with a pivot shaft, and including a front portion extendible outward of the base and engageable into the cavity of the striker plate, for locking the door panel, and a locking device provided for locking the latch to the base, to prevent the latch from being rotated relative to the base.

The base includes a fence extended therefrom and having an opening for rotatably receiving the latch. The latch includes a chamber for receiving a pawl of the locking device which has a first end pivotally secured to the latch with an axle and which has a second end, and a tongue provided on the second end of the pawl, and a biasing device provided for biasing the tongue of the pawl to engage with the base and to lock the latch to the base.

The latch includes a first end having a notch formed by two ears, for receiving the first end of the pawl, the axle is engaged through the first end of the pawl and the ears of the latch. The base includes a bulge for engaging with the tongue and for locking the latch to the base.

A limiting device is further provided for limiting the pawl to move relative to the latch, and includes a beam engaged through the chamber of the latch, and engageable with the pawl, for preventing the pawl from moving out of the chamber of the latch.

A disengaging device is further provided for disengaging the tongue of the pawl from the base, and includes a spring for biasing the tongue of the pawl away from the base.

The disengaging device includes a bar having a first end pivotally secured to the base, and having a second end engaged with the pawl, the spring is engaged between the second end of the bar and the base.

A limiting device is further provided for limiting a movement of the bar relative to the base and includes a catch pivotally supported on the base, and having a pair of recesses formed therein for selectively receiving the bar.

The bar is retained in a lower position when the bar is received in a first of the recesses of the catch, and in a higher position when the bar is received if a second of the recesses of the catch.

The disengaging device includes a lever pivotally secured to the base with a rod, and having a first end engaged with the pawl for moving the pawl inward the chamber of the latch. The lever includes a second end having a hand grip for rotating the lever and for forcing the first end of the lever to move the pawl inward the chamber of the latch.

The disengaging device includes a forcing device provided for forcing the first end of the lever to move the pawl inward the chamber of the latch, and having an actuator rotatably supported in the base and having at least one actuating surface formed therein and engaged with the first end of the lever.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
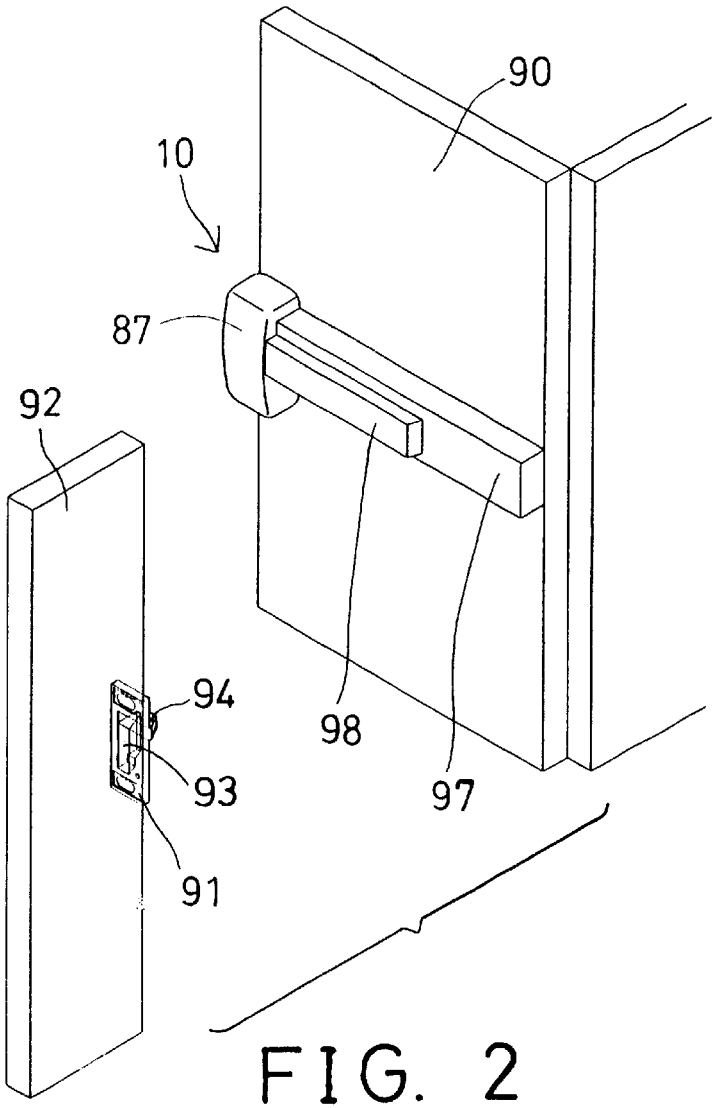
FIGS. 1, 2 are partial perspective views illustrating the attachment of a door lock assembly in accordance with the present invention onto the door of a house building.
Figure 1:
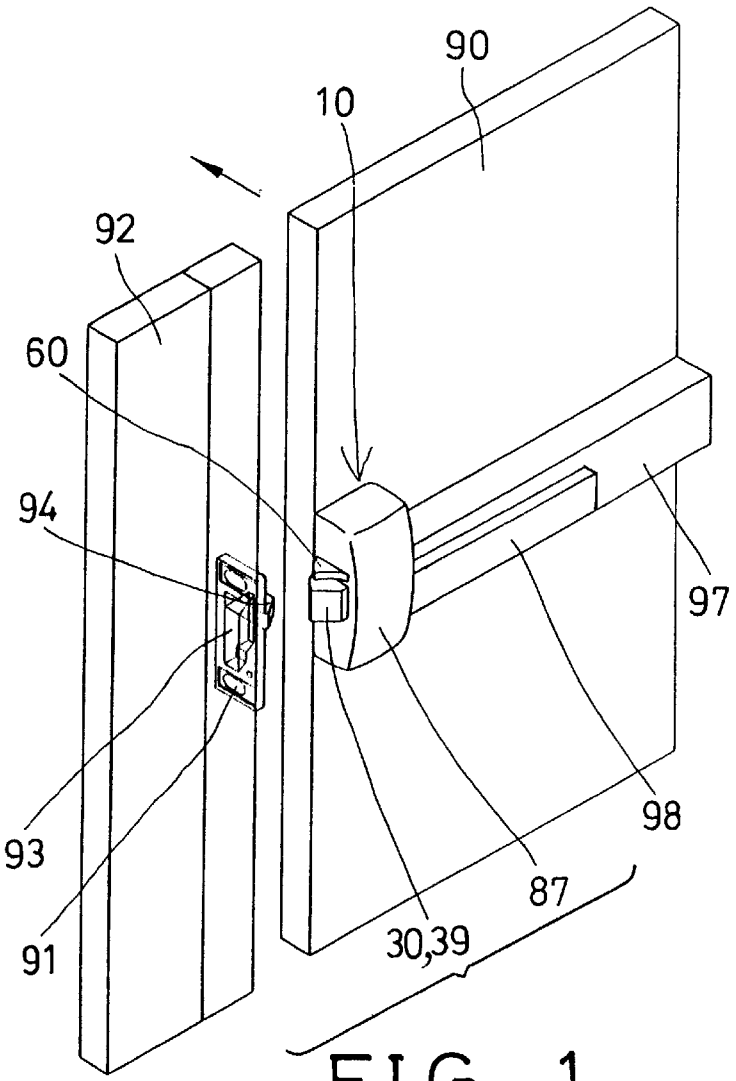
Figure 3:
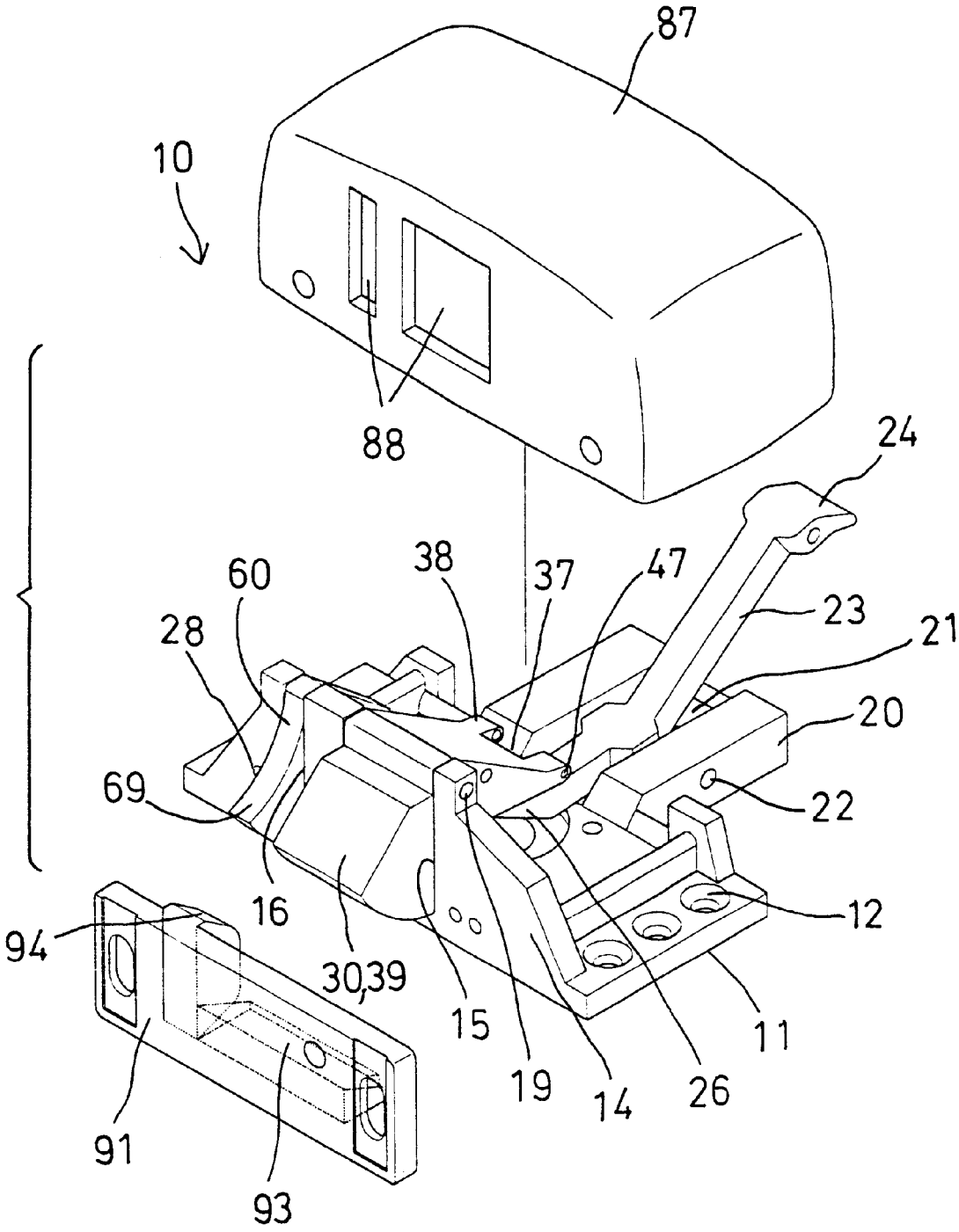
FIG. 3 is a partial exploded view of the door lock assembly.
Figure 4:
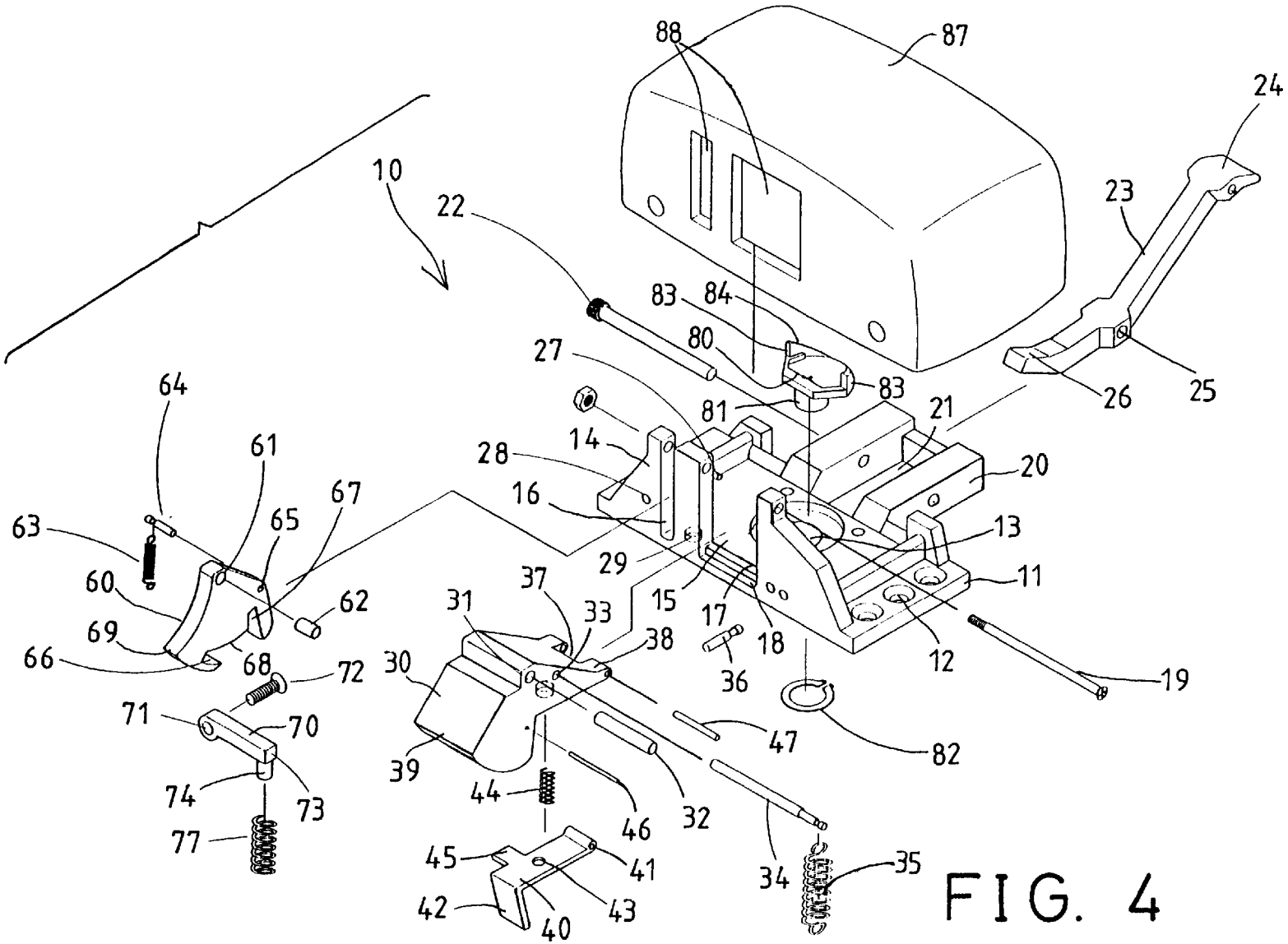
FIG. 4 is an exploded view of the door lock assembly.

Referring to the drawings, and initially to FIGS. 1–3, a door lock assembly in accordance with the present invention is generally indicated with a reference numeral "10" and is to be attached onto a door panel 90, and comprises a striker plate 91 attached onto a door frame or a wall 92 and including one or more cavities 93 formed therein, for locking the door panel 90 to the door frame or the wall 92, and for preventing the door panel 90 from being opened from outside by the unauthorized persons, and for allowing the door panel 90 to be easily opened from inside the house building.

As shown in FIGS. 3–10, the door lock assembly 10 includes a base 11 having one or more holes 12 formed therein for receiving fasteners (not shown) which may secure the base 11 onto the door panel 90. The base 11 includes an orifice 13 formed in the middle portion thereof, and includes a fence 14 extended upward from the front portion thereof. The fence 14 includes an opening 15 and a channel 16 formed therein. The base 11 includes a bulge 17 extended upward and inward or into the opening 15 of the fence 14 for forming or defining a shoulder 18 in front of the bulge 17. A pivot shaft 19 is secured in the fence 14 and engaged through the opening 15 and the channel 16 of the fence 14.

The base 11 includes a seat 20 extended rearward therefrom and having a space 21 formed therein. A rod 22 is secured in the seat 20 and engaged or extended through the space 21 of the seat 20. A lever 23 includes a hand grip 24 formed on one end thereof, and includes a middle portion received in the space 21 of the seat 20, and includes a hole 25 formed in the middle portion thereof for receiving the rod 22, and for pivotally securing the middle portion of the lever 23 to the seat 20 of the base 11. The lever 23 includes the other end 26 located above the orifice 13 of the base 11. The base 11 includes a pin 27 provided therein, and an aperture 28 formed in the fence 14.

A latch 30 is received in the opening 15 of the fence 14, and includes a hole 31 formed in the middle portion thereof for receiving the shaft 19, and for allowing the latch 30 to be rotatably or pivotally secured to the fence 14 of the base 11. A tubular member or a sleeve 32 may further be provided and engaged between the shaft 19 and the latch 30, for allowing the latch .30 to be smoothly rotated relative to the base 11 or the fence 14 about the shaft 19. A post 34 has one end secured to a rear portion 33 of the latch 30, and located behind the shaft 19.

A spring 35 has one end coupled to the post 34, and the other end coupled to a pole 36 which is secured to the fence 14 or to the base 11, for biasing or forcing the front portion 39 of the latch 30 to engage into the cavity 93 of the striker plate 91, and thus for latching or securing the door panel 90 to the door frame or the wall 92. The latch 30 includes a chamber 301 formed therein (FIGS. 9, 10), and includes a notch 37 formed in the rear portion thereof, and formed or defined by or between a pair of ears 38.

Figure 6:
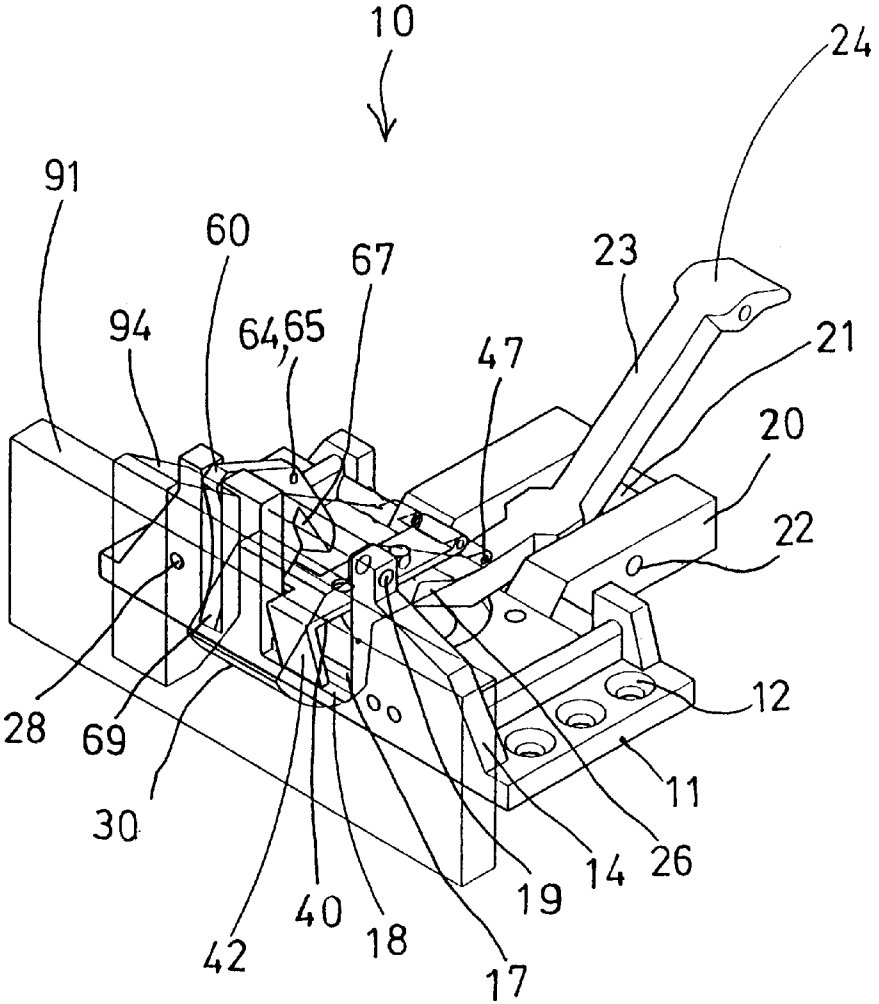
Figure 9:
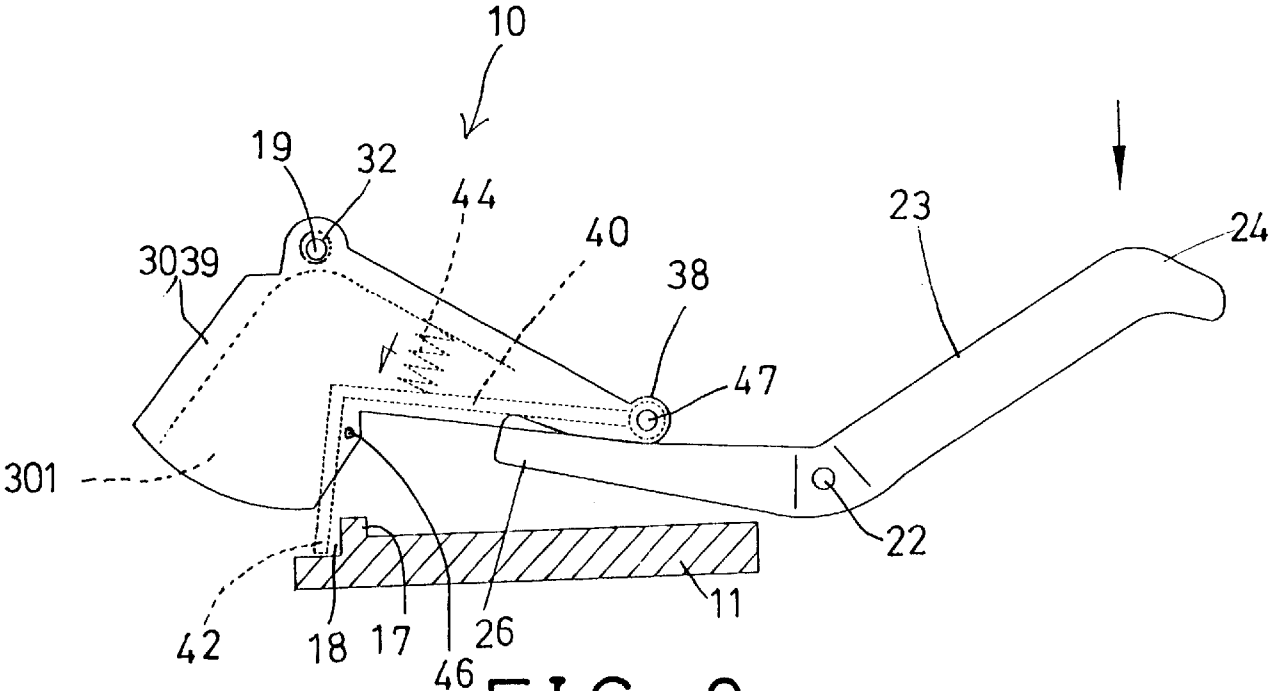
FIGS. 9, 10 are side schematic views illustrating the operation of the door lock assembly.
Figure 8:
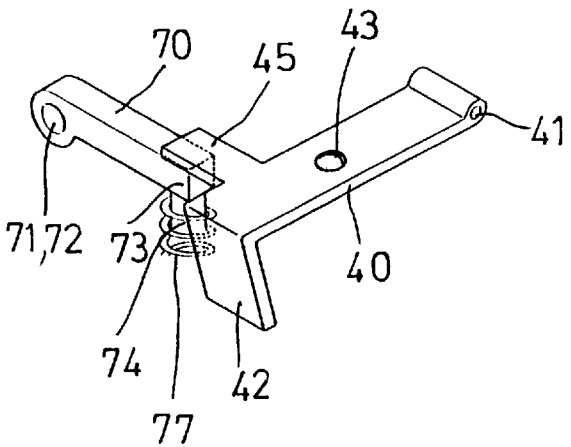
FIG. 8 is a partial perspective view of the door lock assembly.

A pawl 40 is received in the chamber 301 of the latch 30, and has one end 41 received in the notch 37 and located between the ears 38 of the latch 30, and pivotally or rotatably secured to the latch 30 with an axle 47, and includes a tongue 42 bent or formed or extended from the other end thereof for engaging with the shoulder 18 or the bulge 17 of the base 11. As best shown in FIGS. 6 and 9, when the tongue 42 of the pawl 40 is engaged with the shoulder 18 or the bulge 17 of the base 11, the pawl 40 and the latch 30 are arranged for preventing the front portion 39 of the latch 30 from being depressed toward or inward or into the opening 15 of the fence 14 or of the base 11, and thus for locking the latch 30 to the base 11.

The pawl 40 includes a depression 43 formed in the middle portion thereof for receiving one end of a spring 44 which has the other end engaged with the latch 30 (FIGS. 9, 10) for biasing and forcing the tongue 42 of the pawl 40 to engage. with the shoulder 18 or the bulge 17 of the base 11. The pawl 40 includes an extension 45 laterally extended therefrom. A beam 46 is engaged through the chamber 301 of the latch 30, for engaging with the pawl 40, and for preventing the pawl 40 from being disengaged or moved out of the chamber 301 of the latch 30. The beam 46 thus forms a limiting device or means for limiting the movement of the pawl 40 relative to the latch 30, or for preventing the pawl 40 from being disengaged from the chamber 301 of the latch 30.

A catch 60 is further provided, and is received in the channel 16 of the fence 14 or of the base 11, and includes a middle or upper portion having a hole 61 formed therein for receiving the shaft 19 and for rotatably or pivotally securing the catch 60 to the fence 14 of the base 11. A sleeve 62 may further be provided and engaged between the shaft 19 and the catch 60, for allowing the catch 60 to be smoothly rotated relative to the base 11 or the fence 14 about the shaft 19. The catch 60 also includes a front end or portion 69 extendible outward of the channel 16 of the fence 14 or extendible outward of the base 11.

The striker plate 91 includes a jut 94 for engaging with the front end or portion 69 of the catch 60, and for moving the front portion 69 of the catch 60 inward of the channel 16 of the fence 14 or inward of the base 11 (FIG. 6).

Another post 64 is secured to a rear portion 65 of the catch 60, and also located behind the shaft 19. A spring 63 has one end coupled to the post 64, and the other end coupled to the pin 27 which may be secured to the fence 14 or to the base 11, for biasing or forcing the front portion 69 of the catch 60 out of the channel 16 of the fence 14, or for biasing the front portion 69 of the catch 60 to engage with the jut 94 of the striker plate 91. The catch 60 includes two recesses 66, 67 formed in the front and the rear portions thereof, and includes a curved guide surface 68 formed between the recesses 66, 67 thereof.

A bar 70 has one end 71 pivotally or rotatably secured to the fence 14 or to the base 11 with a pivot pin 72 which may, for example, be engaged through the aperture 28 of the fence 14. The bar 70 includes a middle portion engaged with the guide surface 68 of the catch 60, and a stud 74 extended from the other end 73 thereof. A spring 77 has one end engaged onto the stud 74, and the other end engaged into a cavity 29 of the base 11 (FIG. 4), for biasing the bar 70 to engage into either of the recesses 66, 67 of the catch 60 (FIGS. 5–7), and thus for retaining or positioning the tongue 42 of the pawl 40 in engagement with or disengaging from the shoulder 18 or the bulge 17 of the base 11. The other end 73 of the. bar 70 is engaged with the extension 45 of the pawl 40 for allowing the pawl 40 to be moved inward of the chamber 301 of the latch 30 by the bar 70 and the spring 77.

Figure 5:
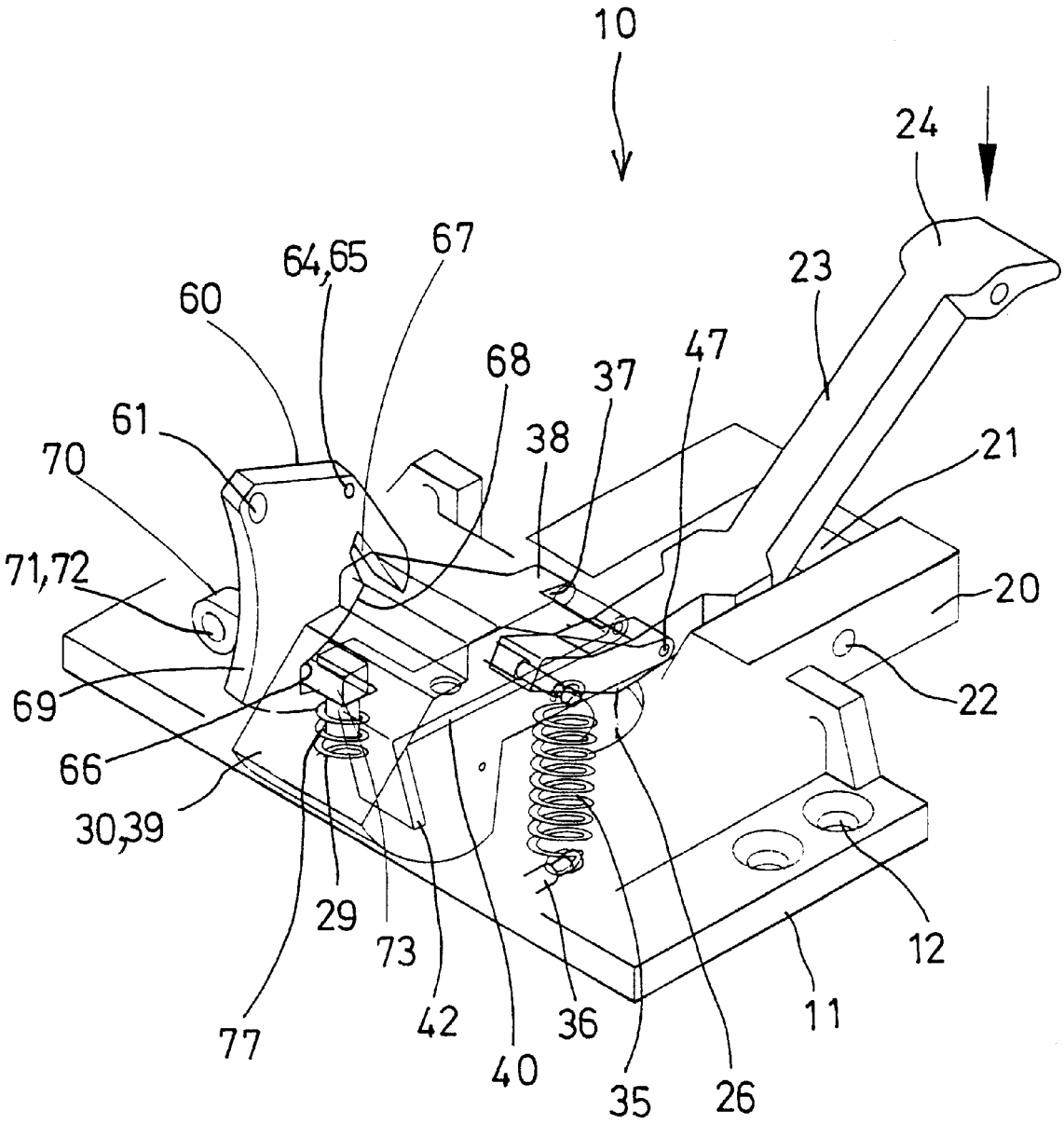
FIG. 5 is a partial perspective view of the door lock assembly, in which the cover has been removed from the door lock assembly.

The recesses 66, 67 of the catch 60 are arranged for receiving and maintaining the bar 70 and thus the pawl 40 in the lower position and in the higher position respectively. For example, as shown in FIGS. 5, 6, when the front portion 69 of the catch 60 is pushed or forced inward of the channel 16 of the fence 14 or inward of the base 11, by the jut 94 of the striker plate 91, the bar 70 may be forced to move into the recess 66 by the guide surface 68 of the catch 60, and may be lowered and maintained in the lower position.

When the bar 70 is retained in the recess 66 of the catch 60 and maintained in the lower position, the tongue 42 of the pawl 40 may be biased to engage with the shoulder 18 or the bulge 17 of the base 11 (FIG. 9), and thus to lock the latch 30 to the striker plate 91, by the spring 44 and/or by the spring 35, such that the spring 44 and/or the spring 35 may form the spring biasing device or means for biasing or forcing the pawl 40 or the tongue 42 to engage with the shoulder 18 or the bulge 17 of the base 11.

At this moment, or when the tongue 42 of the pawl 40 is biased to engage with the shoulder 18 or the bulge 17 of the base 11, the latch 30 may be locked to the base 11 and may be prevented from rotating relative to the base 11 by the pawl 40, such that the front portion 39 of the latch 30 may be prevented from being depressed toward or inward or into the opening 15 of the fence 14 or of the base 11. For example, when any unauthorized person engage a planar member into the gap formed between the striker plate 91 and the base 11, or formed between the door 90 and the door frame or the wall 92, and try to prize open the latch 30, the latch 30 may be locked by the pawl 40 and may not be opened from outside of the door.

It is to be noted that the pawl 40 and/or the bar 70 may thus form a locking device or means for locking the latch 30 to the base 11 (FIG. 9), and for preventing the latch 30 from being prized or opened from outside of the door 90. The catch 60 may form a device or a means for limiting the bar 70 and thus the pawl 40 to move relative to the base 11 or relative to the latch 30.

Figure 7:
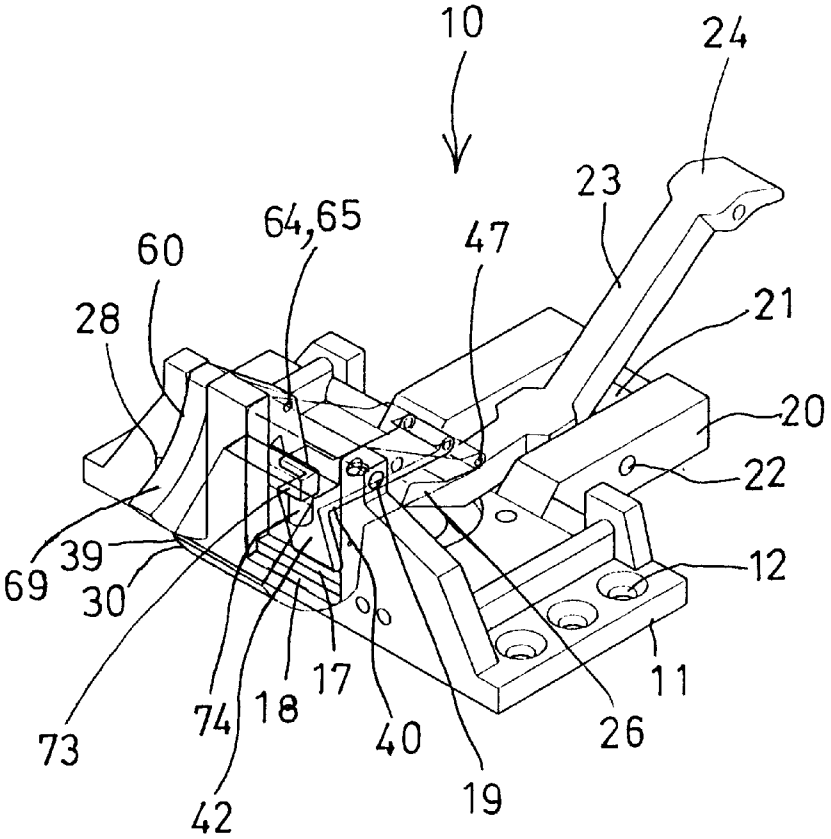
FIGS. 6, 7 are partial perspective views similar to FIG. 5, illustrating the operation of the door lock assembly.

As shown in FIGS. 3, 7, when the front portion 69 of the catch 60 is biased or forced outward of the channel 16 of the fence 14 or of the base 11, by the spring 63, the bar 70 may be forced to move into the other recess 67 by the guide surface 68 of the catch 60, and may be elevated and maintained in the higher position, such that the tongue 42 of the pawl 40 may be elevated and disengaged from the shoulder 18 or the bulge 17 of the base 11 (FIG. 10), and such that the latch 30 may no longer be locked to the striker plate 91, and such that the front portion 39 of the latch 30 may be depressed toward or inward or into the opening 15 of the fence 14 or of the base 11 at this moment. The bar 70 and the spring 77 and/or the lever 23 may thus form a device or a means for selectively disengaging the tongue 42 of the pawl 40 from the bulge 17 of the base 11.

Figure 10:
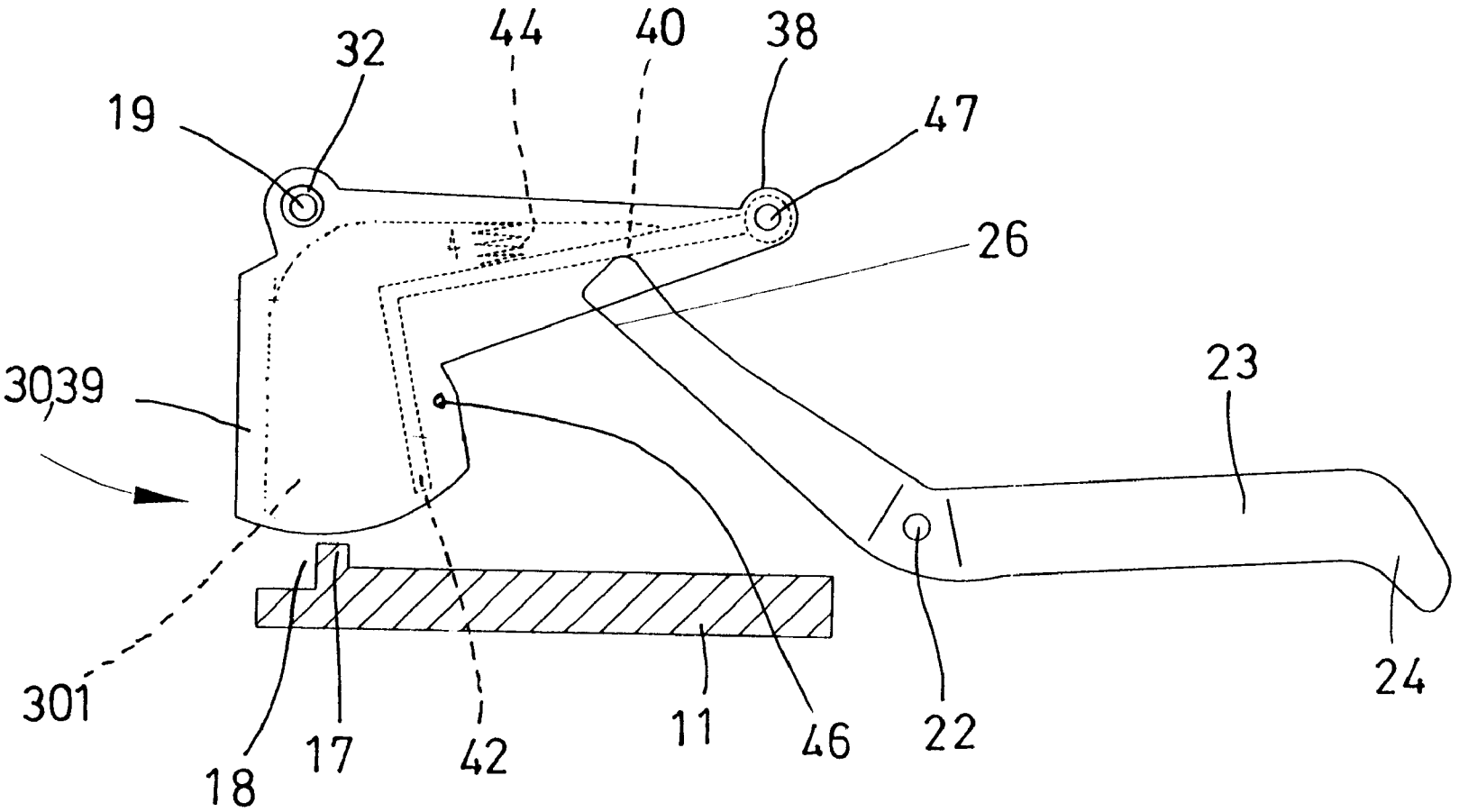

As shown in FIGS. 9, 10, when the hand grip 24 of the lever 23 is depressed toward the base 11, the other end 26 of the lever 23 may be moved away from the base 11 and may be engaged with the pawl 40 and may actuate or force the tongue 42 of the pawl 40 to be disengaged from the shoulder 18 or the bulge 17 of the base 11, in order to release or to unlock the latch 30 from the base 11, and for allowing the front portion 39 of the latch 30 to be depressed toward or inward or into the opening 15 of the fence 14 or of the base 11.

As shown in FIGS. 1 and 2, the door panel 90 may include a receptacle 97 formed or attached thereto for receiving the lever 23 therein, and may include a slidable or movable presser 98 slidably attached to the receptacle 97 and engageable with the hand grip 24 of the lever 23, for depressing the hand grip 24 to move the other end 26 to disengage the tongue 42 of the pawl 40 from the shoulder 18 or the bulge 17 of the base 11, and thus to unlock the latch 30 from the base 11, for allowing the latch 30 to be rotated relative to the base 11 about the shaft 19.

An actuator 80 includes a barrel 81 extended downward therefrom and rotatably engaged in the orifice 13 of the base 11 and rotatably secured to the base 11 with a clamping or retaining ring 82, and includes one or more, such as two swellings 83 extended upward therefrom and each having an inclined actuating surface 84 formed thereon for engaging with the other end 26 of the lever 23, and for forcing the other end 26 of the lever 23 to disengage the tongue 42 of the pawl 40 from the shoulder 18 or the bulge 17 of the base 11, when the actuator 80 is rotated relative to the base 11.

Figure 12:
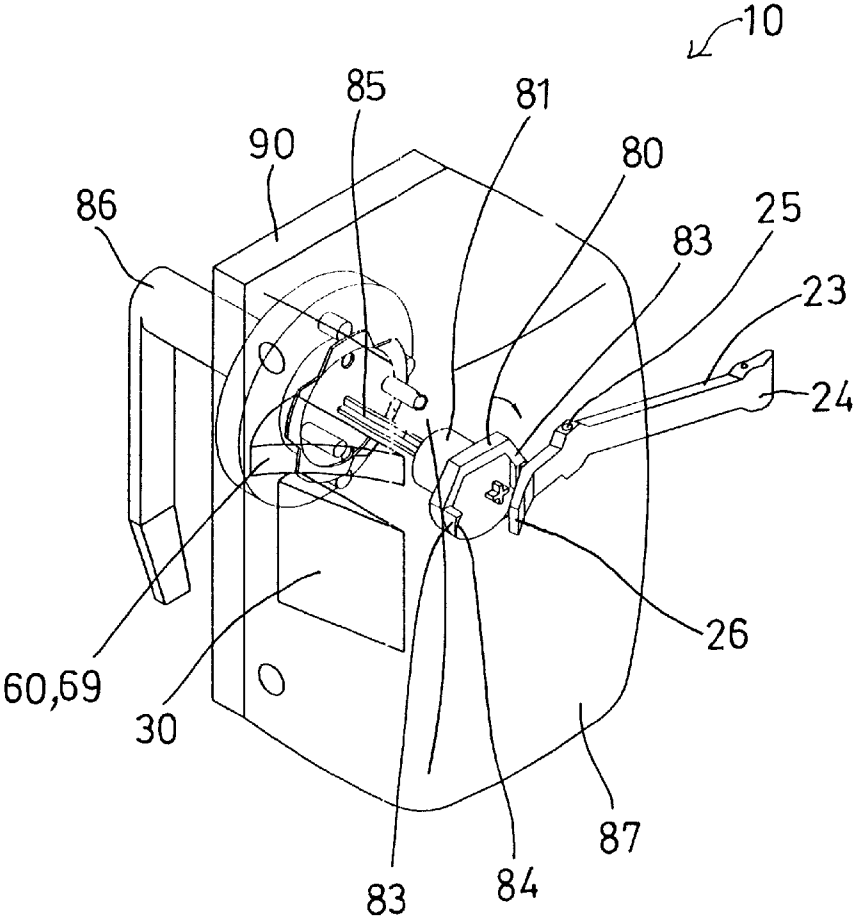
FIGS. 11, 12 are schematic views illustrating the operation of the door lock assembly.
Figure 11:
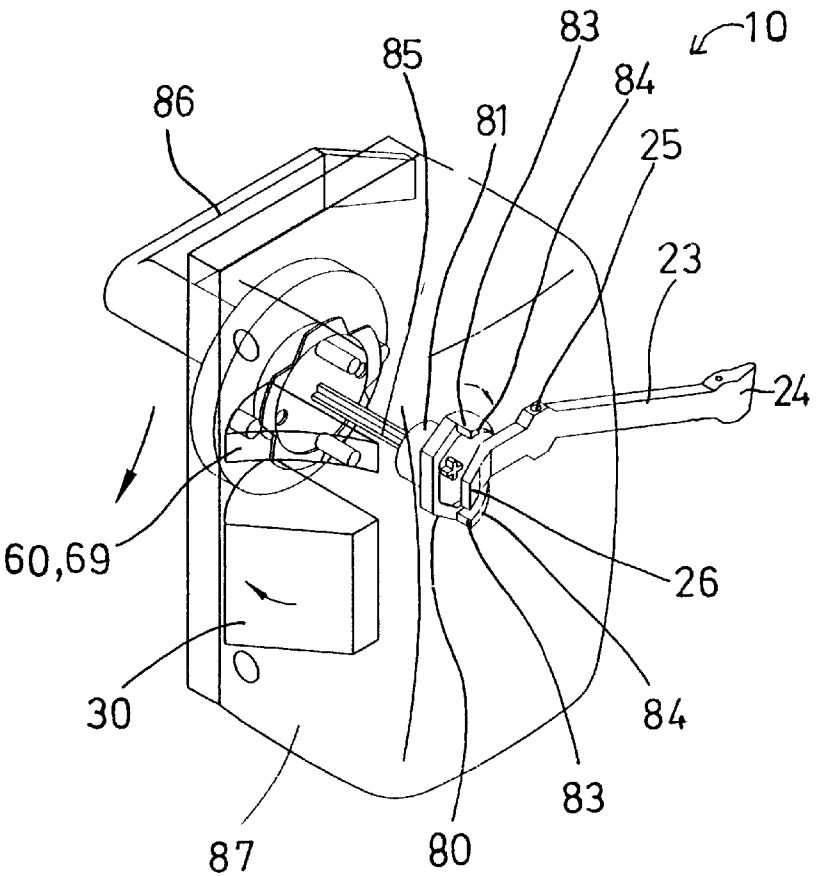

As shown in FIGS. 11 and 12, a pole 85 is engaged through the door panel 90 and has one end secured in the barrel 81 of the actuator 80, and the other end extended outwardly of the door panel 90 and secured to a handle 86 which may be rotated relative to the door panel 90 when a typical lock member is unlocked by a correct key (not shown). The actuator 80 may thus be rotated by the handle 86 to actuate the other end 26 of the lever 23 to unlock the pawl 40 and the latch 30 from the base 11, when the handle 86 is unlocked by the correct key. A cover 87 may be secured onto the base 11 for shielding the actuator 80, and includes one or more apertures 88 formed therein for receiving the catch 60 and the latch 30 respectively.

The actuator 80 may also be directly engaged with the pawl 40 in order to unlock the tongue 42 of the pawl 40 from the shoulder 18 or the bulge 17 of the base 11, instead of via the other end 26 of the lever 23. The actuator 80 and/or the lever 23 may thus form an unlocking device or means for moving the pawl 40 inward the chamber 301 of the latch 30, or for unlocking the pawl 40 from the base 11, or for disengaging the tongue 42 from the shoulder 18 or the bulge 17 of the base 11.

In operation, as shown in FIGS. 1, 6, the tongue 42 of the pawl 40 may be biased to engage with the shoulder 18 or the bulge 17 of the base 11 (FIG. 9), in order to lock the latch 30 to the striker plate 91, when the door panel 90 is closed and when the front portion 69 of the catch 60 is pushed or forced inward of the channel 16 of the fence 14 or inward of the base 11, by the jut 94 of the striker plate 91, and when the bar 70 is forced to move into the recess 66 by the guide surface 68 of the catch 60 and when the bar 70 is maintained in the lower position. The latch 30 may thus be locked to the base 11 and may be prevented from being prized from outside of the door.

The pawl 40 may be moved inward the chamber 301 of the latch 30, and the tongue 42 of the pawl 40 may be disengaged from the shoulder 18 or the bulge 17 of the base 11, in order to unlock the latch 30 from the striker plate 91, by depressing the hand grip 24 or by rotating the lever 23 to force the other end 26 of the lever 23 to move the pawl 40 inward the latch 30, or by rotating the actuator 80 by the handle 86. The door panel 90 may thus be easily opened by depressing the hand grip 24 of the lever 23 or by depressing the presser 98, from inside of the door panel 90.

Accordingly, the door lock assembly in accordance with the present invention includes a safety and anti-theft structure, for preventing the door from being opened from outside of the door, and for allowing the door to be easily opened from inside of the house building.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door lock assembly for a door panel, said door lock assembly comprising:

a striker plate including a cavity formed therein, a base, a latch rotatably supported on said base with a pivot shaft, and including a front portion extendible outward of said base and engageable into said cavity of said striker plate, for locking the door panel, said latch including a chamber formed therein, and means for locking said latch to said base, to prevent said latch from being rotated relative to said base, said locking means including a pawl received in said chamber of said latch and having a first end pivotally secured to said latch with an axle and having a second end, and a tongue provided on said second end of said pawl, and means for biasing said tongue of said pawl to engage with said base and to lock said latch to said base.

2. The door lock assembly according to claim 1, wherein said base includes a fence extended therefrom and having an opening formed therein for rotatably receiving said latch.

3. The door lock assembly according to claim 1, wherein said latch includes a first end having a notch formed therein and formed by two ears, for receiving said first end of said pawl, said axle is engaged through said first end of said pawl and said ears of said latch.

4. The door lock assembly according to claim 1, wherein said base includes a bulge extended therefrom for engaging with said tongue and for locking said latch to said base.

5. The door lock assembly according to claim 1 further comprising means for limiting said pawl to move relative to said latch.

6. The door lock assembly according to claim 5, wherein said limiting means includes a beam engaged through said chamber of said latch, and engageable with said pawl, for preventing said pawl from moving out of said chamber of said latch.

7. The door lock assembly according to claim 1 further comprising means for disengaging said tongue of said pawl from said base.

8. The door lock assembly according to claim 7, wherein said disengaging means includes a spring for biasing said tongue of said pawl away from said base.

9. The door lock assembly according to claim 8, wherein said disengaging means includes a bar having a first end pivotally secured to said base, and having a second end engaged with said pawl, said spring is engaged between said second end of said bar and said base.

10. The door lock assembly according to claim 7, wherein said disengaging means includes a bar engaged with said pawl, and means for biasing said bar to force said tongue of said pawl away from said base.

11. The door lock assembly according to claim 10 further comprising means for limiting a movement of said bar relative to said base.

12. The door lock assembly according to claim 11, wherein said limiting means includes a catch pivotally supported on said base, and having a pair of recesses formed therein for selectively receiving said bar.

13. The door lock assembly according to claim 12, wherein said bar is retained in a lower position when said bar is received in a first of said recesses of said catch, and in a higher position when said bar is received in a second of said recesses of said catch.

14. The door lock assembly according to claim 7, wherein said disengaging means includes a lever pivotally secured to said base with a rod, and having a first end engaged with said pawl for moving said pawl inward said chamber of said latch.

15. The door lock assembly according to claim 14, wherein said lever includes a second end having a hand grip for rotating said lever and for forcing said first end of said lever to move said pawl inward said chamber of said latch.

16. The door lock assembly according to claim 7, wherein said disengaging means includes means for forcing said first end of said lever to move said pawl inward said chamber of said latch.

17. The door lock assembly according to claim 16, wherein said forcing means includes an actuator rotatably supported in said base and having at least one actuating surface formed therein and engaged with said first end of said lever.

18. The door lock assembly according to claim 17, wherein said actuator includes at least one swelling extended therefrom and having said at least one actuating surface formed therein for engaging with said first end of said lever.

* * * * *